US006568481B2

(12) United States Patent
Koehler et al.

(10) Patent No.: US 6,568,481 B2
(45) Date of Patent: May 27, 2003

(54) DEEP WELL INSTRUMENTATION

(75) Inventors: Kurt D. Koehler, Bakersfield, CA (US); Gary O. Harkins, Bakersfield, CA (US)

(73) Assignees: Sensor Highway Limited, Andover (GB); Aera Energy LLC, Bakersfield, CA (US)

( * ) Notice: Subject to any disclaimer, the term of this patent is extended or adjusted under 35 U.S.C. 154(b) by 0 days.

(21) Appl. No.: 09/849,588

(22) Filed: May 4, 2001

(65) Prior Publication Data

US 2002/0162666 A1 Nov. 7, 2002

(51) Int. Cl.[7] ..... E21B 47/01
(52) U.S. Cl. ..... 166/385; 166/250.01; 166/375
(58) Field of Search ..... 166/66.4, 324, 166/332.2, 386, 385, 250.01, 375, 250.08

(56) References Cited

U.S. PATENT DOCUMENTS

| | | | | |
|---|---|---|---|---|
| 4,167,303 A | | 9/1979 | Bowen et al. | 350/96.21 |
| 4,423,782 A | | 1/1984 | Bowyer | 166/321 |
| 4,696,542 A | | 9/1987 | Thompson | 350/96.2 |
| 4,790,393 A | * | 12/1988 | Larronde et al. | 175/40 |
| 4,976,142 A | | 12/1990 | Perales | 73/151 |
| 5,018,574 A | * | 5/1991 | Smith | 166/185 |
| 5,033,808 A | | 7/1991 | Smith et al. | 350/96.2 |
| 5,163,321 A | | 11/1992 | Perales | 73/151 |
| 5,184,692 A | * | 2/1993 | Moriarty | 175/50 |
| 5,570,437 A | | 10/1996 | Kluth et al. | 385/12 |
| 5,803,167 A | * | 9/1998 | Bussear et al. | 166/65.1 |
| 5,804,713 A | | 9/1998 | Kluth | 73/152.01 |
| 5,808,192 A | | 9/1998 | Schmidt | 73/152.55 |
| 5,831,156 A | | 11/1998 | Mullins | 73/152.18 |
| 5,947,198 A | * | 9/1999 | McKee et al. | 166/66.4 |
| 5,992,250 A | | 11/1999 | Kluth et al. | 73/866.5 |
| 6,041,857 A | * | 3/2000 | Carmody et al. | 166/66.4 |
| 6,176,312 B1 | * | 1/2001 | Tubel et al. | 166/250.15 |
| 6,186,229 B1 | | 2/2001 | Martin | 166/250.08 |

FOREIGN PATENT DOCUMENTS

| | | |
|---|---|---|
| GB | 2185574 | 7/1987 |
| GB | 2305724 | 4/1997 |
| WO | 0206625 | 1/2002 |

OTHER PUBLICATIONS

H.E. Lindsey, Jr. "Running and Cementing Deep Well Liners"—(Title) Nov. 1974 World Oil vol. 179 No.6 p 85–88; p 85 RMC Line 5–14 Fg. 1B.

Interna;'l Search Report EP01 306951 Aug. 21, 2002–13 The Hague.

* cited by examiner

*Primary Examiner*—Frank Tsay
(74) *Attorney, Agent, or Firm*—Robert W. J. Usher

(57) ABSTRACT

A fiber optic instrumentation line is introduced down a hydrocarbon (oil) well bore 12 by control line 16 formed by pressure tubing conduit fixed on the outside of intermediate casing 14 and set in cement slurry 21 between casing 14 and surrounding rock 13 and reaching to the hydrocarbon production zone 15. Hollow primary member 18 accepts distal end of control line 16 at the end of casing 14. Secondary member 22 having sealed terminal control line 27 on its outer surface is lowered through primary member 18 to zone 15, automatically angularly aligning and engaging respective top and bottom end couplings 24 and 20, sealing together a respective top and end of terminal control lines 27, 16 forming a continuous, high pressure, fiber optic receiving tube, from well head 10 to well bottom. Alternatively, two lines 16 linked by loop 26 provide a continuous control line returning to the surface.

40 Claims, 7 Drawing Sheets

DEEP WELL INSTRUMENTATION

FIELD OF THE INVENTION

The present invention relates to deep wells which are drilled into the ground for extraction of fluid or gaseous materials. The invention particularly relates to oil, gas or hydrocarbon wells. Most particularly, the invention relates to means for providing instrumentation in the depths of an oil, gas or production well.

BACKGROUND TO THE INVENTION

In drilling an oil well, it is customary to commence with a wellhead which provides a steel surface casing, generally around 46 cm (18 plus inches) in diameter. As drilling proceeds, successive sections of a steel intermediate casing are inserted, stage by stage, into the well bore, set in place with concrete slurry, and residual, set, internal concrete slurry plugs drilled out to continue the well bore down until a production zone, where hydrocarbon is found to be present in extractable quantities, is reached. Once contact has been made with the production zone, production tubing, of smaller diameter than the intermediate casing, is introduced down to the production zone, ready to extract hydrocarbon. A perforated production liner, intermediate in diameter (around 18 cm, otherwise 7" or smaller)between that of the production tubing and that of the intermediate casing, may be extended beyond the end of the intermediate casing and the production tubing, allowing ingress of hydrocarbon into the production liner. The production liner allows hydrocarbon to flow into the production tubing but the intermediate casing is plugged, or sealed using a packer, against ingress of hydrocarbon from the production liner.

Fibre optic sensor line has been used, for some years, in the oil industry, to collect data from oil wells. The data collected primarily relates to temperature. Techniques exist whereby transmitted and backscattered light in a fibre optic line can be analysed to extract much useful information. Such techniques are not part of this invention. The instant invention is concerned, rather, with the introduction of a fibre optic line into an oil well.

Well data is of great economic importance, allowing the operator to give more effective surveillance to the well and thereby to enhance the productivity of the well. In these days of slimmer margins of economic viability in oil wells, and falling reserves, such data may be vital for the economy of the oil industry and, by extension, to the greater economy of the world, as a whole.

The fibre optic line is extremely fragile. It has a diameter, even with coating and sleeving, of no more than one millimeter. Its internal reflective properties can be compromised by surface contaminants. Being made of glass, it can shatter and break. It has a minimum radius of curvature below which it certainly breaks.

The environment in an oil well is extremely hostile. Drill bits, capable of penetrating hard rock, are lowered into the well and rotated with great torque by heavy steel tubes. Heavy steel casings are lowered into the drill shaft to line the shaft. The drill shaft is filled with cement and mud slurries. Residual cement plugs, once a slurry has set, are drilled out. An oil well represents a very hazardous environment for a fibre optic line.

In order to protect the fibre optic line from mechanical damage or contamination, it is customary to use control line. Control line, in the oil industry, is remarkably like metal hydraulic tubing, as used in industrial, agricultural and building site machinery. It is tough, usually 0.6 cm (¼ inch) in outside diameter, able to sustain high pressures up to 15000 psi (100 Mega Pascals), thermally conductive, can be joined in lengths by couplings, and provides a protected, clear channel down which a fibre optic line or electrical cable can be fed.

Installing a continuous length of fibre optic line, in the current art, requires the use of a continuous length of control line. Currently, to investigate an oil well, lengths of control line are strapped to the outside of a string of steel casings which are passes down the well to reach and to cross the zone of interest, where measurements are required or desirable. Alternatively, the control line is run inside a protective oilfield tubing string, on the inside of the well bore, down to and across the zone of interest.

Should the zone of interest turn out to be the required producing interval, it is customary to complete an oilwell by topping off the zone of interest with a set concrete casing and inserting a perforated production liner into and through the zone of interest. This creates a well with two separated strings of pipes, albeit concentric.

The completion of a well with a set concrete casing and a production liner precludes running a single length of fibre optic line, inside control line, down to and across the zone of interest, while maintaining the fibre optic line external to the well bore. The plug, through which the production liner passes, blocks off the end of the intermediate casing run, preventing the fibre optic line from passing out of the end of the intermediate casing and isolating the inside of the intermediate casing from the zone of interest.

When stimulating a well, a substantial advantage is gained by being able to gather distributed temperature data, without interfering with the near well bore area and without data being masked by the presence of a hydraulically isolated zone. When fibre optic line is installed on the inside of the well bore, the well bore becomes inaccessible to other tools. The control line and the (optional) protective tubing string reduce the room available for the tools. The fragility, even of a protective tubing string and control line protected fibre optic line, and the loss of room, mean that ancillary tools cannot be inserted or operated down a well bore where a fibre optic installation is maintained. Before ancillary tools are run down the well bore, it is necessary first to retrieve the fibre optic line. Stimulation of the well can then take place, or tools run, but without the gathering of data that could have a significant impact on well productivity.

With the fibre optic line in the well bore, any fluid flowing in the well bore can affect the fibre optic line. Its temperature readings no longer reflect, with accuracy, the temperature of the rock external to the well bore, but are altered or dominated by the fluid in the well bore.

An internally installed and maintained fibre optic line, in a string of protective tubing (pipes), restricts the flow of the well and requires a larger diameter well bore to accommodate the string of protective tubing/pipes and allow adequate flow. Well bores cost a great deal of money to create, and the price rises steeply with their diameter.

It is costly to install a control line across the producing interval. Therefore, a small diameter tubing, known as a "stinger", is used to support the control line and lower it down the well bore into the region of interest or production zone. The present invention, as well as its other advantages, also seeks to provide means which eliminate the cost, time, and well incapacity that results from the intrusive use of a "stinger".

The present invention has, as its object, the provision of apparatus, method and means, capable of allowing the introduction and maintenance of a fibre optic line, passing into and across the zone of interest, with a portion thereof external to the wellhead, capable of being maintained in position while other operations are carried out in the well bore, unaffected by fluids flowing in the well bore and eliminating the need for a well bore of increased diameter.

BRIEF SUMMARY OF THE INVENTION

According to a first aspect, the present invention consists in an apparatus for providing a down-hole conduit for carrying an instrumentation line for use with a well bore in a substrate, the instrumentation line passing from the surface, towards the bottom of the well bore; said apparatus comprising: a hollow primary member, for insertion to extend into the well bore; said primary member comprising a first line of conduit on the outer surface thereof and primary coupling means for accepting the distal end of said first line of conduit; said apparatus further comprising a secondary member comprising a terminal conduit and secondary coupling means for accepting the free end of said terminal conduit; said secondary member being insertable through said hollow first member for said primary coupling means to couple with said secondary coupling means for the distal end of said first line of conduit to be coupled to said free end of said terminal conduit.

According to a second aspect, the present invention consists in method for providing a down-hole conduit for carrying an instrumentation line for use with a well bore in a substrate, the instrumentation line passing from the surface, towards the bottom of the well bore; said method including the steps of: inserting a hollow primary member to extend into the well bore; providing a first line of conduit on the outer surface of said primary member; providing primary coupling means for accepting the distal end of said first line of conduit; providing a secondary member comprising a terminal conduit and secondary coupling means for accepting the free end of said terminal conduit; and inserting said secondary member through said hollow first member for said primary coupling means to couple with said secondary coupling means for the distal end of said first line of conduit to be coupled to said free end of said terminal conduit.

The invention further provides for a method and apparatus wherein the primary member comprises a second line of conduit on the outside thereof; wherein the primary coupling means is operative to accept the distal end of the second line of conduit; wherein the terminal conduit is a loop of conduit; wherein the secondary coupling means accepts both free ends of the loop of conduit; and wherein the primary coupling means, on coupling with the secondary coupling means, couples the distal ends of the first and said second lines of conduit each to a respective one of the free ends of the loop of conduit; whereby the instrumentation line is passable through the loop of conduit back towards the surface.

The invention provides that the secondary member can be hollow and that the conduit loop is on the outside of the secondary member.

The invention further provides that the primary member and the secondary member, when coupled together, can form a continuous tube.

The invention further provides that the secondary member can be self locating on the primary member.

The invention further provides that the primary member can comprise a locating scoop, that the secondary member can comprise a locating tongue, and that the locating scoop and the locating tongue are co-operative to bring the primary coupling means and the secondary coupling means into angular registration for coupling as the secondary member is lowered through the primary member.

The invention further provides that the primary coupling means comprises one or the other of a coupling probe or a coupling socket and that the secondary coupling means comprises the other or one of the coupling probe or the coupling socket, and that the coupling probe and the coupling socket, on coupling, can form a sealed coupling between the distal end of one of the lines of conduit and one of the free ends of the loop of conduit.

The invention further provides a hollow modified member, the modified member having a secondary coupling means at its top end for accepting the proximal ends of two extension conduits, and having primary coupling means at its bottom end for accepting the distal ends of the two extension conduits, and provides that the modified member can be inserted through the primary member for the secondary coupling means on the modified member to couple with the primary coupling means on the primary member.

The invention further provides that a further modified member can be inserted through the modified member for the secondary coupling means on the further modified member to couple with the primary coupling means on the further modified member.

The invention further provides that the secondary member can be inserted through the modified member for the secondary coupling means on the secondary member to couple with the primary coupling means on the modified member.

The invention further provides that the secondary member can be inserted through the further modified member for the secondary coupling means on the secondary member to couple with the primary coupling means on the further modified member.

The invention further provides that the conduit can be control line and that the apparatus can be designed for use where the instrumentation line is a fibre optic line.

In the preferred embodiment, it is preferred that the primary member is set into the well bore with concrete or cement. It is further preferred that the well bore is part of an oilwell.

The invention is further explained by the example given in the following description and drawings

DETAILED DESCRIPTION OF THE PREFERRED EMBODIMENT

Figure 1A:
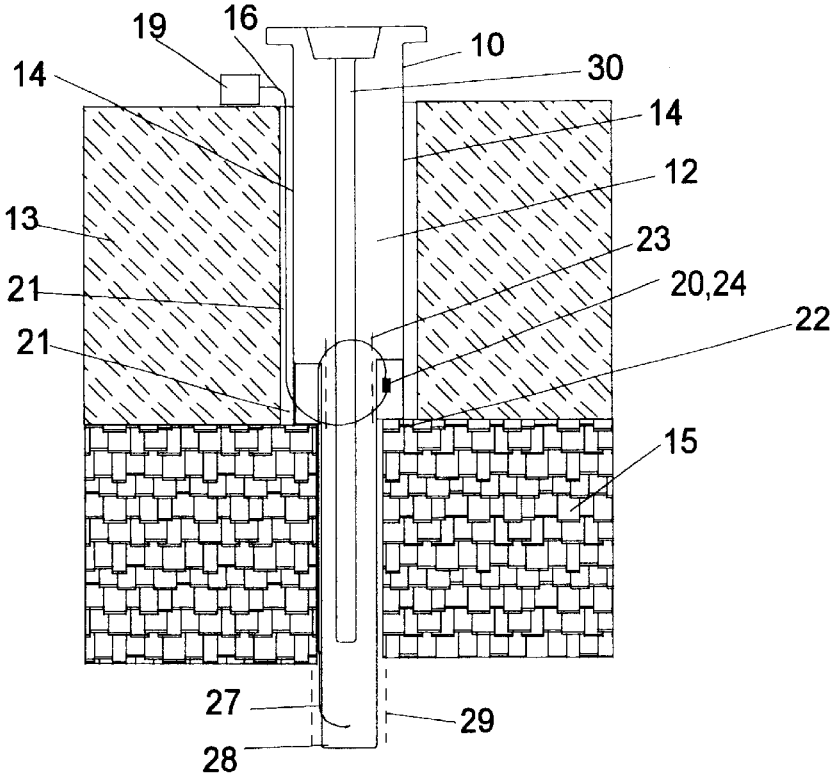
FIG. 1A is a cross sectional schematic view, with shortened vertical scale, of an oil well incorporating the present invention, illustrating the manner in which a control line can be conducted into and down the hydrocarbon well using the primary and secondary members of the invention.

Attention is first drawn to FIGS. 1A, showing a hydrocarbon well, in the form of an oilwell incorporating the present invention.

A wellhead 10 is set into a well bore 12 and provides support, control and registration for further operations in a manner well known in the art. The well bore 12 descends, through the surrounding rock 13 to a zone of interest 15 wherefrom hydrocarbon is to be extracted. Intermediate casing 14 is then lowered into the well bore with at least one or more parallel, adjacent, lines of control line 16 attached to the outer surface thereof. In this example a single conduit, in the form of a single control line 16 line is shown. The primary member 18 of the present invention is attached to the lower end of the intermediate casing 14 and carries the single control line from a fibre optic connection module 19 to primary coupling 20 on the primary member. The primary member is hollow, allowing cement 21 slurry to be pumped into the intermediate casing 14 and forced up from the bottom of the well bore 12 between the intermediate casing 14 and the surrounding rock 13. When the cement 21 has set, the single control line 16 is encased between the steel intermediate casing 14 and the rock 13 surrounding the well bore 12. The primary coupling 20 is protected by a primary coupling protective sleeve 23, a soft metal tube, on the inside of the primary member 18, which prevents slurry 21 or other debris entering the primary coupling 20 and against damage from drilling operations.

The cement slurry 21 having set, a drill bit is lowered through the primary member and the residual cement plug at the bottom of the well bore 12 is drilled out. Downward drilling continues until a bore of sufficient depth has been achieved to accept the secondary member 22. A tool, on a drilling string, is lowered into the primary member 18, the primary coupling protective sleeve 23 is engaged, and is then removed by being drawn up the well bore 12 with the drilling string. The primary member 18 and the well bore 12 are, at this stage, ready to receive the secondary member 22.

The secondary member 22 is of a smaller outer diameter than the hollow interior of the primary member 18 and passes through the primary member 18 for the top portion of the secondary member 22 to engage the top portion of the primary member 18 to effect coupling. The secondary member 22, like the primary member 18, is also hollow, allowing a clear path from the wellhead 10 to the zone of interest 15. When the secondary member 22 is lowered into the intermediate casing 14, it couples with the primary member 18.

In coupling, the top portion of the secondary member 22 and the top portion of the primary member 18 automatically mechanically align. The primary coupling 20 comes together with a secondary coupling 24 on the secondary member. The secondary coupling 24 carries the end of a terminal control line 27. When the secondary member 22 has self-located on the primary member, the single control line 16, terminated at the top end of the primary member 18 at the primary coupling 20,is mated, by the aligned engagement of the primary coupling 20 and the secondary coupling 24, with the terminal control line (conduit)27, which is closed and sealed at its far end. The single control line 16, and the terminal control line 27, are thereby joined to form a continuous, sealed length of control line, passing from the fibre optic connector module 19 at the surface, down to the bottom of the well bore 12 and into and through the zone of interest 15. A fibre optic line can thus be passed, from the fibre optic connector module 19, through the control line 16 26, down the single control line and down the terminal control line 27. More than one fibre optic line, and even electrical devices can be passed into and through the zone of interest. Items can be replaced when damaged or when it is desired to measure a different parameter. All these actions can be accomplished from the surface, with no intervention in the well bore 12.

The advantage of the invention extends further. So far, the description shows how a fibre optic line (or similar item) can be passed down to the zone of interest 15 without mechanical intervention in the well bore 12. The invention also permits continuous monitoring of the zone of interest 15 while permitting other operations to take place in or via the well bore 12.

In the example shown, secondary member 22 is attached to the top end of a production liner 28, a perforated steel tube which allows ingress of oil. The terminal control line 27 is attached to the outside of the production liner 28 which extends through the zone of interest 15. The terminal control line 27 thus extends right through the zone of interest.

The control line 16 is protected against mechanical activity in the well bore 12 by being on the outside of the intermediate casing 14, and encased in concrete 21 between the surrounding rock 13 and the intermediate casing 14. The terminal control line 27 is protected against mechanical activity in the well bore 12 and the zone of interest 15 by being on the outside of the production liner 28. The terminal control line 27 is further protected against hazards from the rock surrounding the production liner 28 and the lower portion of the secondary member 22 by the presence of a terminal control line protective sleeve 29. The protective sleeve 29 is a sturdy metal sleeve, preferably of steel or titanium., which runs down the outside of the secondary member 22 from at least where it exits the primary member 18 down to at least as far as the deepest point for the terminal control line 27. It is thus possible to execute further drilling, or other activities, with the instrumentation (fibre optic line) in place. The primary member 18 and the secondary member 22, both being hollow, permit tools, slurries and probes to be passed through them for operation.

In the example shown, the wellhead 10 is set for production by the introduction, into the zone of interest 15, of production tubing 30 which allows oil to be pumped from the production liner 28 to the wellhead 10.

The terminal control line 27, being on the outside of the production liner 28, is in intimate thermal contact with the contents of the zone of interest 15, and is not affected by thermal effects of flow in the production liner 28. The control line 16, being on the outside of the intermediate casing 14, is isolated from fluids and conditions in the well bore 12, being in close thermal contact with the surrounding rock 13. The present invention thus provides thermal fidelity for the fibre optic line.

These advantages are achieved in a well bore of normal dimensions.

Figure 1B:
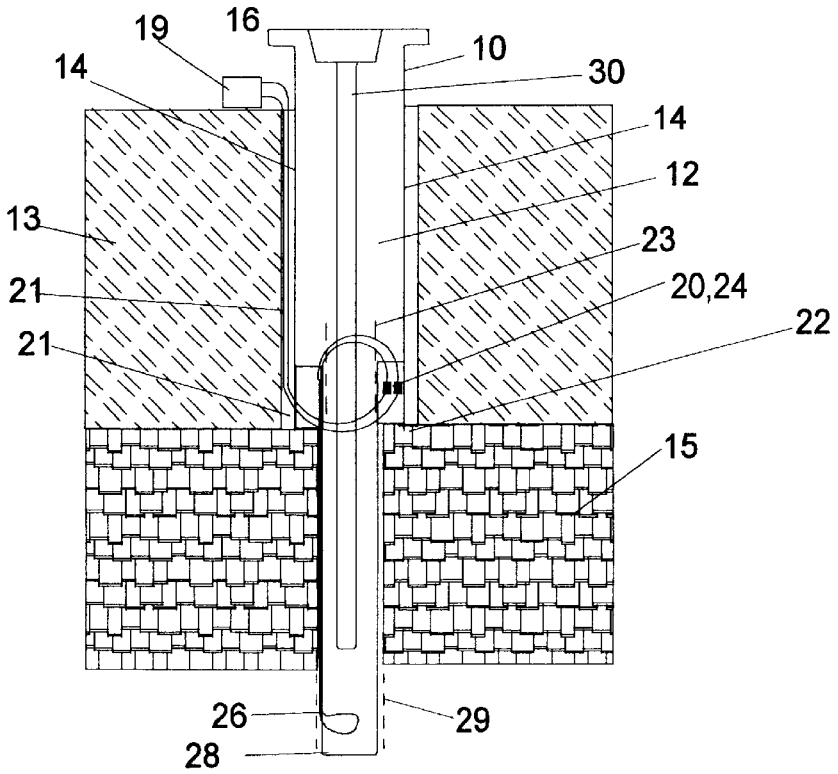
FIG. 1B is a similar diagram, and shows another embodiment of the invention where the control line can be conducted down the hydrocarbon well, around in a loop and back out of a hydrocarbon well using the primary and secondary members of the present invention.

Attention is drawn to FIG. 1B showing a second embodiment of the invention. The single control line 16 is replaced with a pair of control lines, each terminating in the first member 18 and each extending from the fibre optic connection module 19. The terminal control line is replaced by a control line loop 26, which loops down from the top of the secondary member, and extends, depth wise, the same amount as the terminal control line 27 would extend and is fixed and protected in just the same way. When the primary and secondary members 18 22 couple, the distal end of each of the pair of control lines 16 is coupled to a respective free end of the control line loop 26. A continuous path is thus formed from the fibre optic connection module 19, down a first one of the control lines 16, around the control line loop 26, and back up to the fibre optic connection module through the second of the pair of control line 16. An instrumentation line can thus be looped, through the continuous path.

Figure 2:
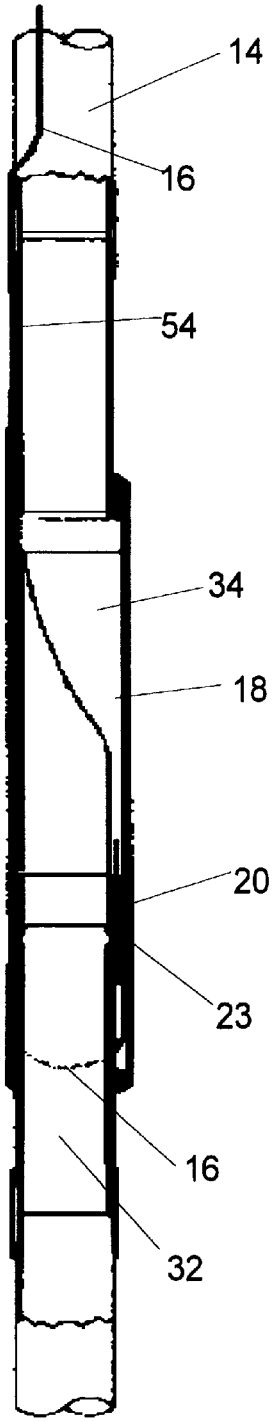
FIG. 2 is a cutaway view, in greater detail, of the primary member of the present invention, installed within an intermediate casing.
Figure 3:
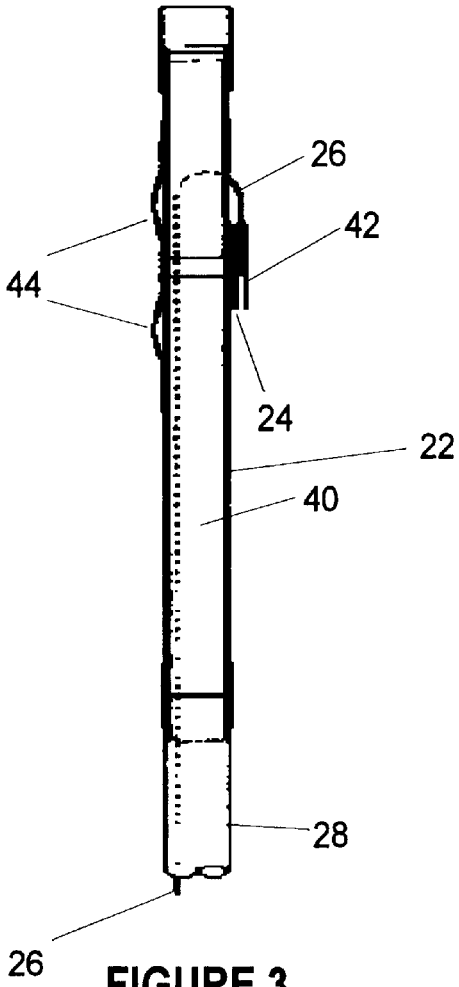
FIG. 3 is a cutaway view of the secondary member of the present invention.
Figure 4:
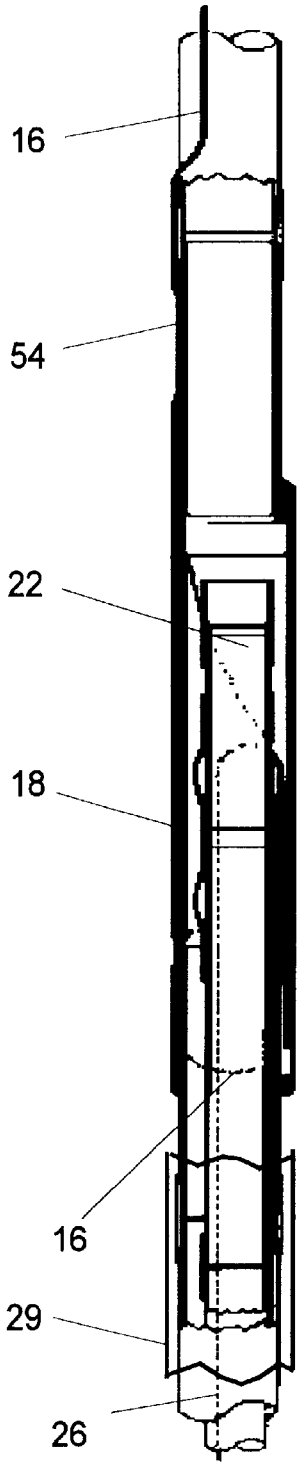
FIG. 4 is a cutaway view of the primary and secondary members of the present invention, coupled together in the oil well.

Attention is drawn to FIGS. 2, 3 and 4 showing, respectively, detailed, cutaway views of the primary member 18 alone, the secondary member 22 alone, and primary 18 and secondary 22 members coupled.

The invention is hereinafter described with a preferred embodiment like that shown in FIG. 1B, where a control line loop 26 is employed as the furthest element for carrying the instrumentation line. It is to be appreciated that, hereinafter, whenever a reference is made to a pair of control lines 16 (as in FIG. 1B), reference is equally made to a single control line 16 (as in FIG. 1A), and when reference is made to control line loop 26, reference is equally made to to a terminal control line 27. It is also to be appreciated that, while just a single control line loop 26 (or terminal control line 27) is shown in FIGS. 1A and 1B, the present invention can be employed to provide a system having a plurality of control line loops 26, a plurality of terminal control lines 27, or a mixture of one or more of each kind.

Returning to FIGS. 2, 3 and 4, the primary member 18, attached to the intermediate casing 14, is in the form of a tube having a central bore 32, extended in diameter and shaped to form a locating scoop 34, which assists in the angular registration and alignment between the primary 18 and secondary 22 members. At the bottom of the locating scoop 34, inside the central bore 32, the primary coupling 20 includes a coupling probe 36 at the end of one of the two control lines 16,accepting the control line 16 from below and pointing upwards. The control line 16 is, in this example, wound around the outside of the primary member.

The secondary member 22 comprises a locating tongue 38 which co-operates with the locating scoop 34 to register and angularly align the primary 18 and secondary 22 members as they are brought into engagement. The secondary member 22 is also in the form of a hollow tube, having a hollow centre 40. The locating tongue 38 is, in this example, integral with the secondary coupling 24, which accepts one end of the control line loop 26, from above, and presents it to a coupling socket 42, facing downwards. A spring 44 is provided on the outside of the secondary member 22, on the side opposite to and spanning the extent of the locating tongue 38.

When the primary 18 and secondary 22 members are brought into engagement, the production liner 28, or any other item intended to lie below the secondary member 22, is passed through the central bore 32 of the primary member 18 until the top of the secondary member 22 approaches the top of the primary member 18. The spring 44 on the secondary member 22 engages the inside of the central bore 32 of the primary member and urges the locating tongue 38 into the locating scoop 34. The locating tongue 38 and the locating scoop 34 co-operate, as the secondary member 22 is further lowered, to rotate the secondary member 22 with respect to the primary member 18 to be in correct angular alignment for the coupling probe 36 to mate with the coupling socket 42. When the primary 18 and secondary 22 members are fully engaged, the primary member 18 supports the secondary member 22 with the coupling probe 36 fully engaged with the coupling socket 42 to provide a continuous run of control line 16 26. The joint between the control line loop 26 and the control line 16 is sealed against any pressure and ingress of outside contaminants, likely to be encountered, by the close mechanical seal achieved between the coupling probe 36 and the coupling socket 42. The hollow centre 40 of the secondary member 22 provides continuity down the well bore 12 for further operations.

FIGS. 2, 3 and 4 show only one end of the control line loop 26 and one of the two lengths of control line 16 being joined. This is an artifact of the chosen view of the drawings. It is to be appreciated that at least two coupling probes 36 and coupling sockets 42 will be provided.

Figure 5:
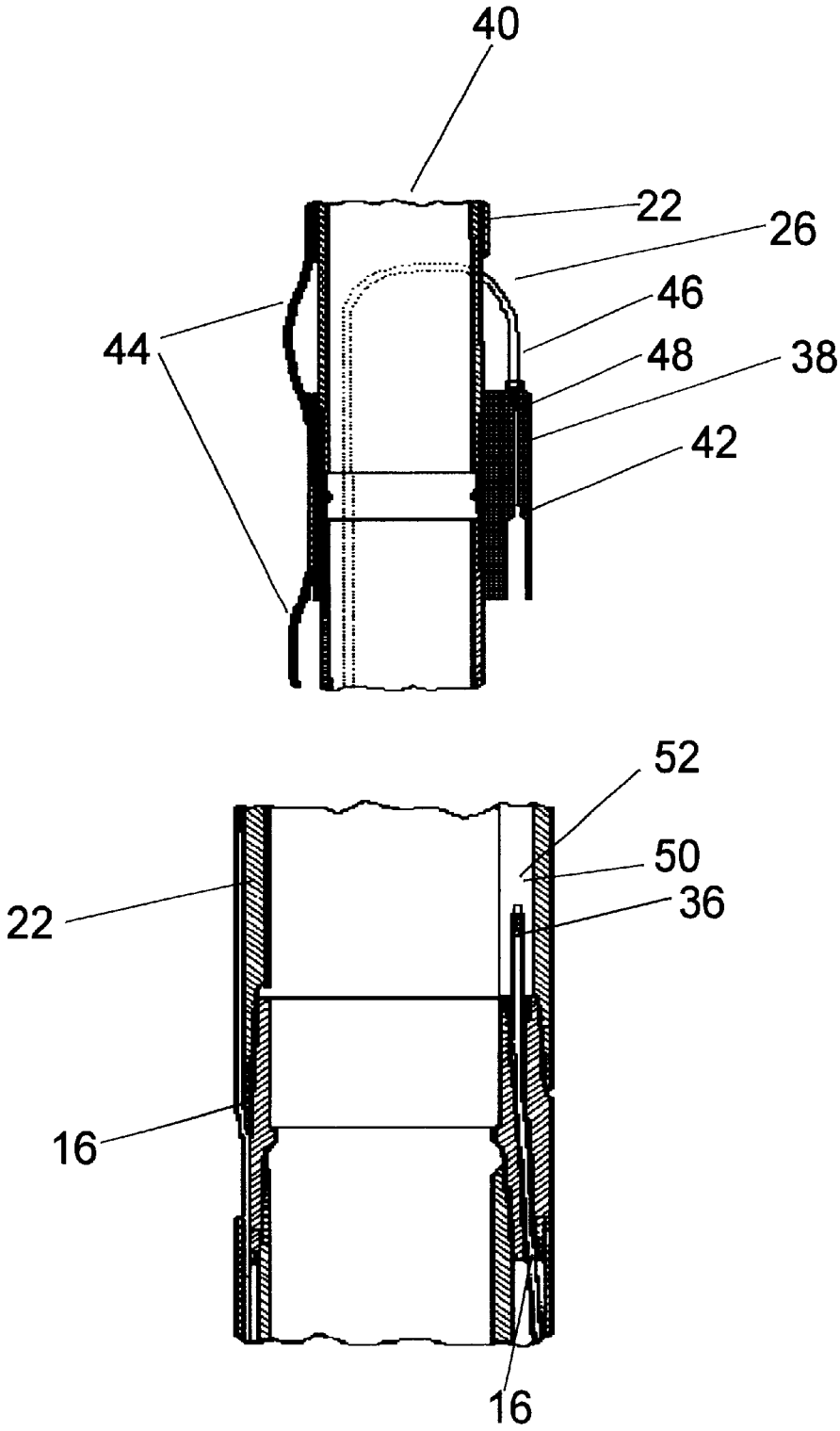
FIG. 5 is a detailed cross sectional view of the coupling elements of the primary and secondary members, lined up prior to coupling.
Figure 6:
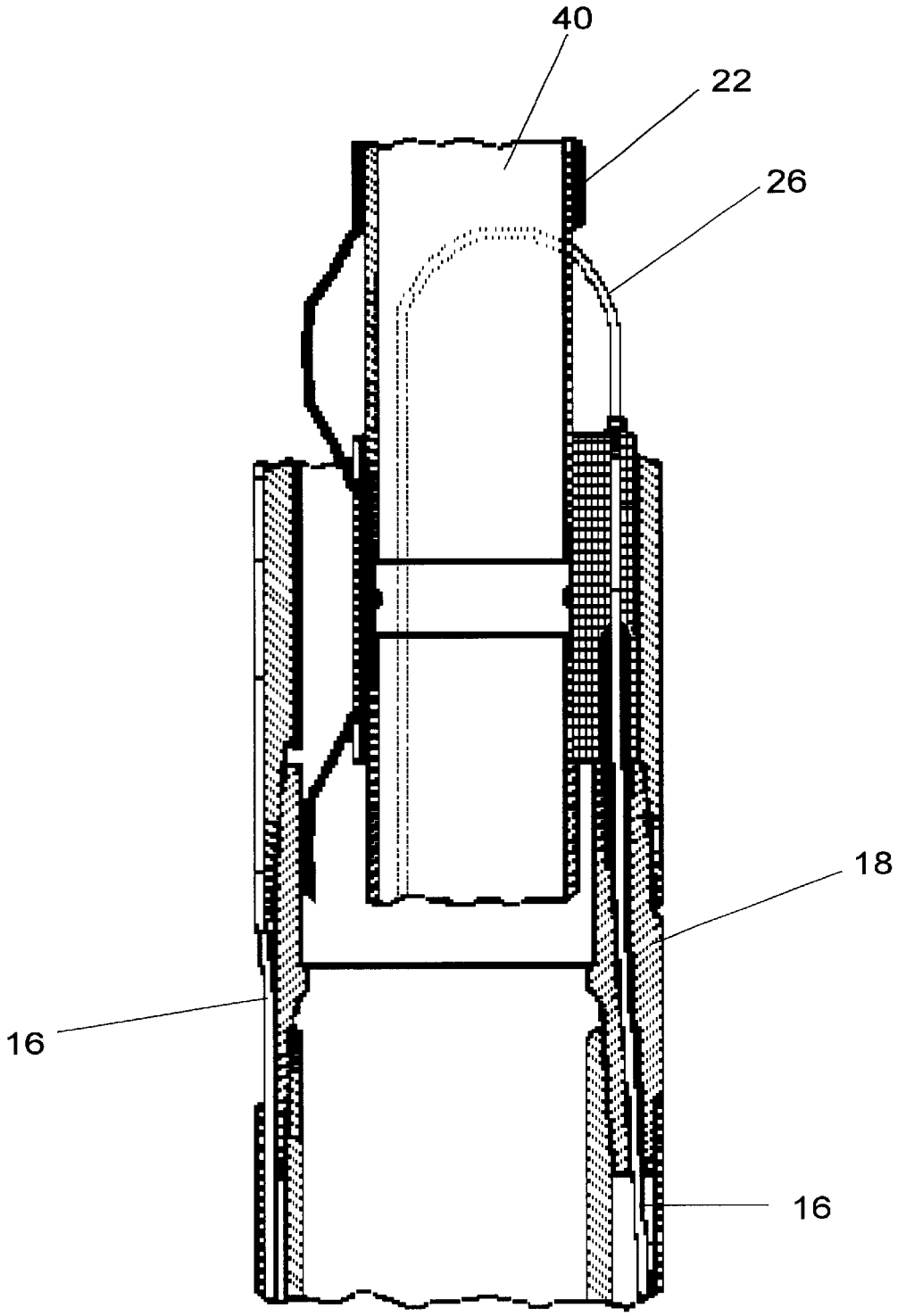
FIG. 6 is a detailed cross sectional view showing the coupling elements of FIG. 5, when coupled.

Attention is drawn to FIGS. 5 and 6, showing, in greater detail, the coupling portions of the primary 18 and secondary 22 members.

The end of the control line loop 26 terminates in a loop gland 46, from the other side of which a secondary coupling tube 48 extends part way along a small diameter channel into the coupling socket 42. The control line 16, within the coupling probe 36, terminates in a tube gland 50 from the other side of which a primary coupling tube extends a short way. When the coupling probe 36 is fully engaged in the coupling socket 42, the ends of the primary coupling tube 52 and of the secondary coupling tube 48 meet exactly within the small diameter channel in coupling socket 42. It is preferred that the coupling probe 36 and the coupling socket 42 are made of resilient material, such as hardened rubber or polymer, capable of making a tight seal against the environment in the well bore 12. The invention also provides that any other form of seal, created on contact, could be used.

Figure 7:
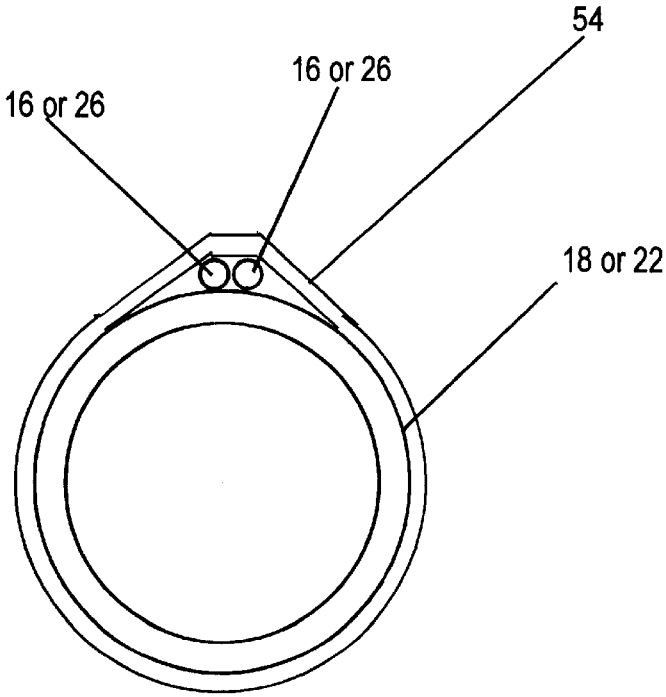
FIG. 7 is a cross sectional view, looking vertically, of either of the primary or secondary members of the present invention, illustrating how control line is held on their exterior.

Attention is drawn to FIG. 7, showing a cross sectional view of a preferred manner of laying the control line 16 or the control line loop 26 on the outside of the primary member 18 or the secondary member 22. The control line 16 or control line loop 26 is laid on the outer surface of the primary member 18 or the secondary member 22 and is held thereon by linearly spaced clamps 54. The control line 16 26 is thus held firmly in place. This is a preferred arrangement, the control line 16 26 being laid in straight lines down the outside of the intermediate casing 14 and the production liner 28 as shown in FIGS. 2, 3 and 4. The invention also permits the attachment of control line 16 26 by other means, such as clips, channels, tension wrapping, gluing or welding.

Figure 8:
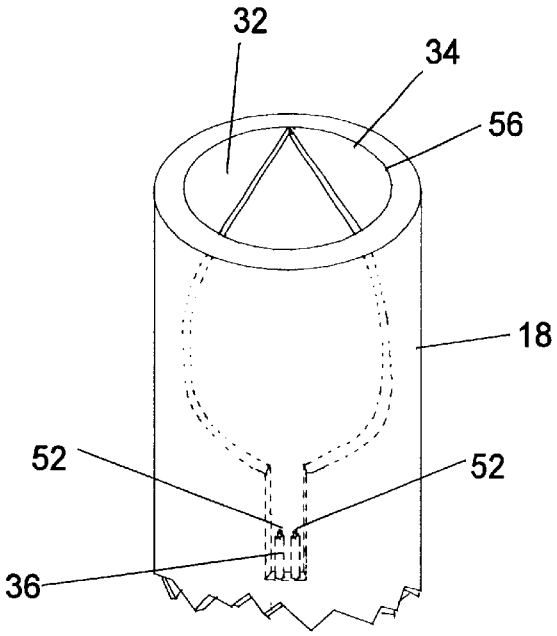
FIG. 8 is an isometric projection of the open upper end of the primary member, illustrating the locating scoop whereby correct angular registration with the secondary member is assured.

Attention is drawn to FIG. 8, showing an isometric projection of the top of the primary member 18, and highlights the construction and function of the locating scoop 34.

The locating scoop 34 is formed by a funnel shaped widening 56 of the central bore 32 of the primary member 18, tapering down to the coupling probes 36, which sit centrally and at the bottom thereof. The funnel shaped widening 56 extends around a portion of the angular extent of the top of the primary member 18. In the preferred example shown, the angular extent of the locating scoop 34 is chosen as 120 degrees, but wider or smaller extents, right up to 360 degrees, allowing the locating tongue 38 to correct its angular registration, even if it is +/−180 degrees out, are within the invention. If the locating tongue 38 is not in the correct angular registration, as the primary 18 and secondary 22 members come together, the funnel shaped widening 56 urges the locating tongue 38, under pressure from the spring 44, towards the centre of the locating scoop 34.

Figure 9:
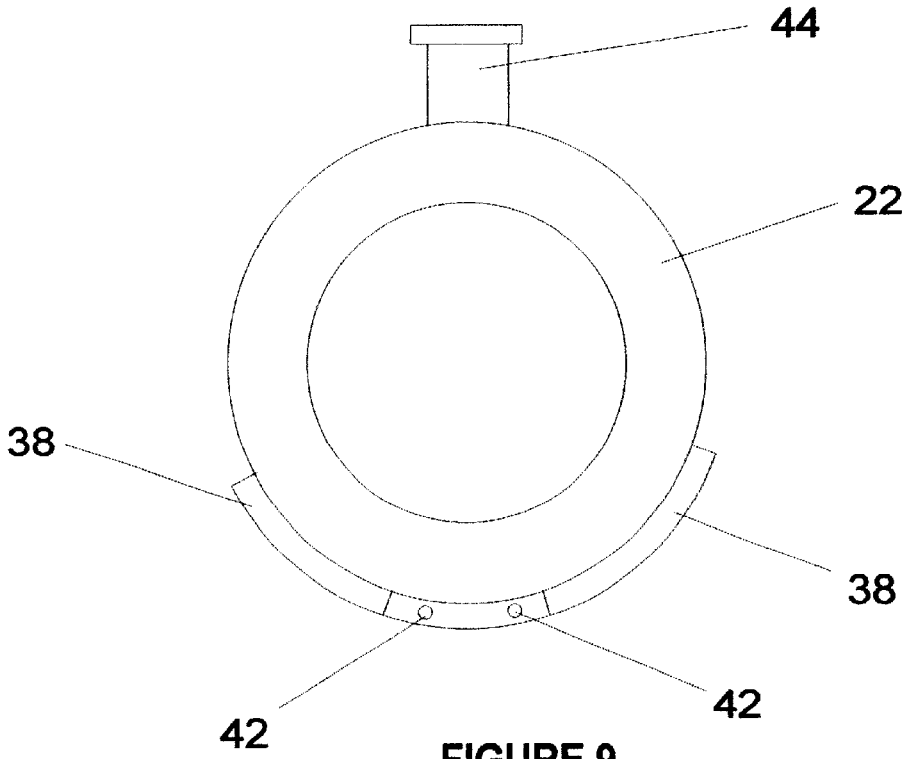
FIG. 9 is a view, from below, of the secondary member, showing the angular disposition of a locating tongue which engages the locating scoop of FIG. 8 and swings the secondary member into correct angular registration with the primary member.
Figure 10:
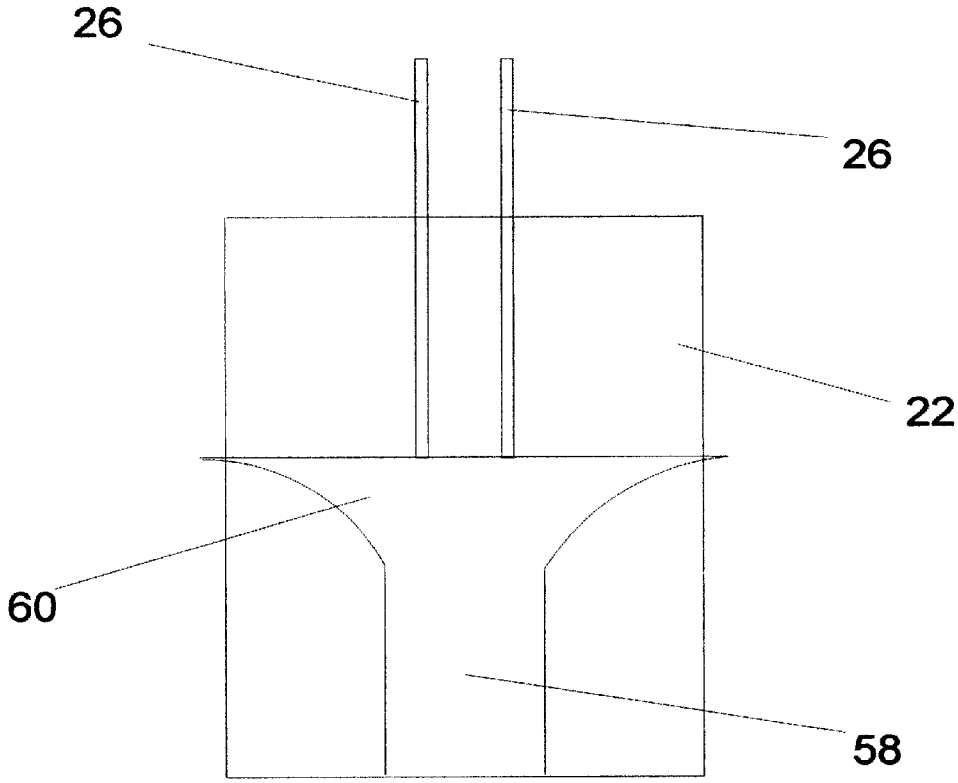
FIG. 10 is a side view of FIG. 9 showing further detail of the locating tongue

Attention is drawn to FIGS. 9 and 10. FIG. 9 shows a view, from below, of a cross section of the secondary member 22, and FIG. 10 shows a side elevation of FIG. 9, looking directly onto the locating tongue 38. The vertical scale of FIGS. 9 and 10 is compressed. In the preferred embodiment, the vertical extent of the locating scoop 34 and the locating tongue 38 are each in the region of 1 meter (3 feet) to 1.5 metres (4.5 feet), though the invention still covers other vertical extents.

The locating tongue 38 is provided on the exterior of the secondary member 22 and, at the lowest part thereof, provides the coupling sockets 42 for the control line loop 26 ends. The locating tongue 38 comprises a straight portion 58 for engaging the coupling probes 36, together, for preference, with a shaped portion 60 for fully engaging the funnel shaped widening 56 in the locating scoop 34 to form a rugged seal.

Figure 11:
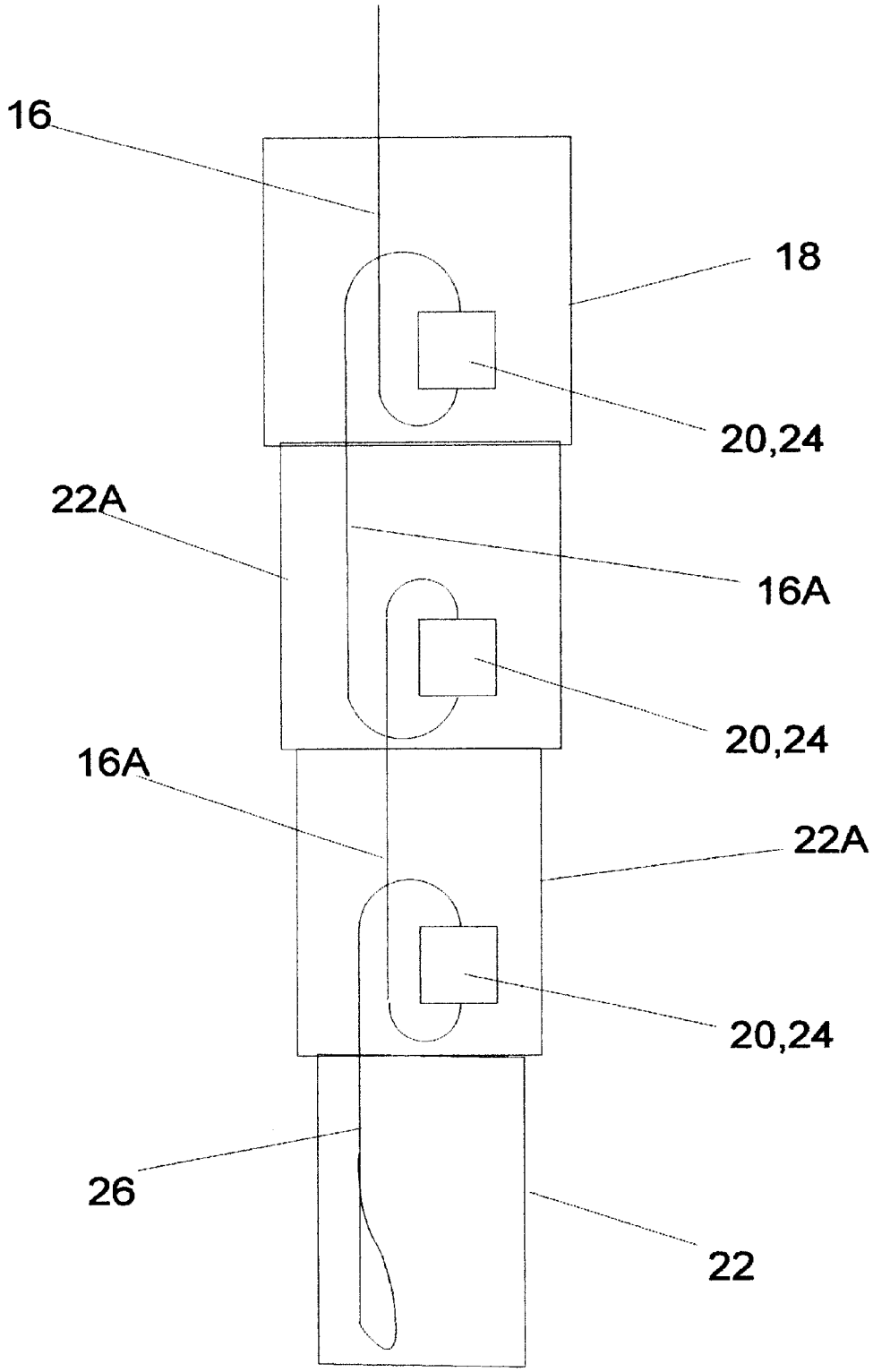
FIG. 11 is a schematic view of a variant preferred embodiment, comprising a chain consisting in a primary member, modified secondary members to whatever number is required, and a secondary member proper. The chain can be extended into the well bore or zone of interest however far the user requires.

Finally, attention is drawn to FIG. 11, showing, schematically, how the invention further provides for extension further into the zone of interest 15, or deeper into the ground, by means of modified secondary members 22.

A primary member 18 comprises a primary coupling 20 which mates a pair of control lines, in the above described way, with a secondary coupling 24 on a modified secondary member 22A. Instead of supporting a control line loop 26, the modified secondary member 22A carries a pair of extension control lines 16A to a primary coupling 20 at its far end. This, in turn, can mate with the secondary coupling at the top of further modified secondary members 22A, until a sufficient depth has been reached. Two modified secondary members 22A are shown in this example. Finally, a true secondary member 22 terminates the string by mating with the primary coupling 20 of the final modified secondary member 22A. Each successive modified secondary member 22A is of a smaller diameter than the preceding primary member 18 or modified secondary member 22A. The whole assembly thus resembles a telescopic car antenna, stretching into the ground.

The invention has so far been explained by way of example and embodiments. The invention is further described by the following claims.

What is claimed is:

1. An apparatus for providing a down-hole conduit for carrying an instrumentation line for use with a well bore, the instrumentation line passing from the surface, towards the bottom of the well bore; said apparatus comprising: a hollow primary member having a proximal end and a distal end, for insertion to extend into the well bore with the distal end remote from the surface; said primary member comprising a first line of conduit on an outer surface thereof, the first line of conduit having a proximal end and a distal end and, the primary member further comprising primary coupling means for accepting the distal end of said first line of conduit; said apparatus further comprising a hollow secondary member having a proximal end and a distal end and a terminal conduit thereon having a proximal, free end and a distal portion and secondary coupling means for accepting the free end of said terminal conduit; said secondary member being insertable, distal end leading, through said hollow primary member for said primary coupling means to couple with said secondary coupling means for the distal end of said first line of conduit to be coupled to said free end of said terminal conduit.

2. An apparatus, according to claim 1, wherein said primary member comprises a second line of conduit on the outer surface thereof, said second line of conduit having a proximal end and a distal end; wherein said primary coupling means is operative to accept the distal end of said second line of conduit; wherein said terminal conduit is a loop of conduit providing another proximal, free end; wherein said secondary coupling means accepts both proximal free ends of said loop of conduit; and wherein said primary coupling means, on coupling with said secondary coupling means, couples the distal ends of said first and said second lines of conduit each to a respective one of said proximal free ends of said loop of conduit; whereby said instrumentation line is passable through said loop of conduit back towards the surface.

3. An apparatus, according to claim 1 or claim 2, wherein said terminal conduit is on the outside of said secondary member.

4. An apparatus, according to claim 1 or claim 2, wherein said primary member and said secondary member, when coupled together, form a continuous tube.

5. An apparatus, according to claim 1, or claim 2, wherein said secondary member is self locating on said primary member.

6. An apparatus, according to claim 5, wherein said primary member comprises a locating scoop, wherein said secondary member comprises a locating tongue, and wherein said locating scoop and said locating tongue are co-operative to bring said primary coupling means and said secondary coupling means into angular registration for coupling as said secondary member is lowered through said primary member.

7. An apparatus, according to claim 1 or claim 2 wherein said primary coupling means comprises one or the other of a coupling probe or a coupling socket and wherein said secondary coupling means comprises the other or one of said coupling probe or said coupling socket, said coupling probe and said coupling socket, on coupling, being operative to form a sealed coupling between the distal end one of said lines of conduit and one of said free ends of said loop of conduit.

8. An apparatus, according to claim 1 or claim 2, wherein said conduit is a control line.

9. An apparatus, according to claim 1 or claim 2, for use where the instrumentation line is a fibre optic line.

10. Apparatus according to claim 1 wherein the or each primary coupling means has a line of conduit receiving portion on an outside surface of the or each member on which the or each primary coupling is provided and a portion for coupling to the or each secondary coupling means on an interior of the or each member on which the or each primary coupling is provided.

11. Apparatus according to claim 1 wherein when a secondary coupling means is coupled with a primary coupling means, the secondary coupling means is located between a outer surface of a member on which it is provided and an inner surface of a member on which the primary coupling means to which the secondary coupling means is coupled is provided.

12. Apparatus according to claim 1, wherein said terminal conduit is a loop of conduit providing another proximal, free end: wherein said primary member comprises a second line of conduit on the outer surface thereof, said second line of conduit having a proximal end and a distal end; and wherein the distal ends of said first and second lines of conduit are each coupled to a respective one of said proximal free ends of said loop of conduit when said primary coupling means couples with said secondary coupling means.

13. An apparatus for providing a down-hole conduit for carrying an instrumentation line for use with a well bore, the instrumentation line passing from the surface, towards the bottom of the well bore; said apparatus comprising: a hollow primary member having a proximal end and a distal end, for insertion to extend into the well bore with the distal end remote from the surface; said primary member comprising a first line of conduit and a second line of conduit on an outer surface thereof, the first and second lines of the conduit each having a respective proximal end and a respective distal end and, the primary member further comprising primary coupling means for accepting the distal ends of the both first and second lines of conduit;

said apparatus further comprising a hollow modified member having a top end and a bottom end and comprising two extension conduits each having a respective top, free end and a bottom end and, secondary coupling means at the top end of the modified member for accepting the top, free ends of the extension conduits; and another primary coupling means at a bottom end of said modified member for accepting bottom ends of said extension conduits, the modified member being insertable, bottom end leading, through said hollow primary member for the primary coupling means of said primary member to couple with the secondary coupling means of the modified member for the the distal ends of both first and second lines of conduit to be coupled to respective proximal, free end of said extension conduits and with the extension conduits exiting from the distal end of the primary member;

said apparatus additionally comprising a secondary member having a proximal end and a distal end and being insertable, distal end leading, through said primary member, said secondary member comprising a terminal conduit looped to provide two proximal, upper, free ends and a distal, returned end portion and, another secondary coupling means on the secondary member for accepting the free ends of said terminal conduit and for coupling with the primary coupling means on the modified member for the distal end of each extension conduit to be coupled to a respective one of the proximal, upper, free ends of said terminal conduit with the distal end of the secondary member and the returned end portion of the terminal conduit extending beyond the bottom end of the modified member whereby said instrumentation line is passable down said first line of conduit and a first extension conduit through said loop of conduit back towards the surface.

14. An apparatus for providing a down-hole conduit for carrying an instrumentation line for use with a well bore, the instrumentation line passing from the surface, towards the bottom of the well bore; said apparatus comprising: a hollow primary member having a proximal end and a distal end, for insertion to extend into the well bore with the distal end remote from the surface; said primary member comprising a first line of conduit on an outer surface thereof, the first line of conduit having a proximal end and a distal end and, the primary member further comprising primary coupling means for accepting the distal end of said first line of conduit;

said apparatus further comprising a hollow modified member having a top end and a bottom end and comprising an extension conduit having a top, free end and a bottom end and, first secondary coupling means at the top end of the modified member for accepting the top, free end of said extension conduit; and another primary coupling means at a bottom end of said modified member for accepting a bottom end of said extension conduit, the modified member being insertable, bottom end leading, through said hollow primary member for the primary coupling means of said primary member to couple with the secondary coupling means of the modified member for the distal end of said first line of conduit to be coupled to said top, free end of said extension conduit with said bottom end of the modified member and said bottom end of said extension conduit exiting from said distal end of the primary member;

said apparatus additionally comprising a secondary member having a proximal end and a distal end and being insertable, distal end leading, through said primary member, the secondary member comprising a terminal conduit having a proximal, free end and a distal end and another secondary coupling means on the secondary member for accepting the free end of said terminal conduit for the primary coupling means on said modified member to couple with the secondary coupling means on said terminal member for said bottom end of said extension line of conduit to be coupled to said free end of said terminal conduit with said distal end of said secondary member and said distal end of said terminal conduit extending from said bottom end of said modified member.

15. An apparatus, according to claim 13 or claim 14, wherein said secondary member is insertable, distal end leading, through said modified member for the secondary coupling means on said secondary member to couple with said primary coupling means on said modified member.

16. An apparatus for providing a down-hole conduit for carrying an instrumentation line for use with a well bore, the instrumentation line passing from the surface, towards the bottom of the well bore; said apparatus comprising: a hollow primary member having a proximal end and a distal end, for insertion to extend into the well bore with the distal end remote from the surface; said primary member comprising a first line of conduit and a second line of conduit on an outer surface thereof, the first and second lines of conduit each having a respective proximal end and a respective distal end and, the primary member further comprising primary coupling means for accepting the distal ends of both first and second lines of conduit;

said apparatus further comprising a first hollow modified member and a further hollow modified member each having a top end and a bottom end and comprising, respectively, first and further pairs of extension conduits, the extension conduits of each pair having, respectively, top, free ends and bottom, free ends; first secondary coupling means and a further secondary coupling means being provided at respective top ends of the first and further modified members, respectively, for accepting, respectively, the top, free ends of the first extension conduits and the top, free ends of the further extension conduits, respectively; and another primary coupling means and a further primary coupling means being provided, respectively, at respective bottom ends of the first modified member and the further modified member, respectively, for accepting, bottom, free ends of the first extension conduits and bottom, free ends of the second extension conduits, respectively, the first modified member being insertable, bottom end leading, through said hollow primary member for said primary coupling means of said primary member to couple with said secondary coupling means of the first modified member for the distal ends of the first and second lines of conduit to be coupled to respective top, free ends of the extension conduits of the first pair with the bottom end of the first modified member exiting from the distal end of the primary member, and the second modified member being insertable, bottom end leading, through said primary member and through said first modified member for said primary coupling means of said first modified member to couple with said secondary coupling means of the second modified member for the bottom ends of the extension conduits of the first pair to be coupled to respective top ends of the extension conduits of the second pair and with the bottom end of the second modified member exiting from the bottom end of the first modified member;

said apparatus additionally comprising a secondary member having a proximal end and a distal end and being insertable through said primary member, said secondary member comprising a terminal conduit looped to provide two proximal, free ends and a distal, returned end portion; another secondary coupling means on the secondary member for accepting the free ends of said terminal conduit for the primary coupling means of said further modified member to couple with the secondary coupling means of said secondary member for respective bottom ends of respective extension conduits of said second pair to be coupled to respective ones of said free ends of said terminal conduit with said distal end of said secondary member and said distal, returned end portion of said terminal conduit extending beyond said bottom end of said second modified member and whereby said instrumentation line is passable down said first line of conduit, a first extension conduit, and a further extension conduit, through said looped conduit back towards the surface.

17. An apparatus, according to claim 16, wherein said secondary member is insertable through said further modified member for the secondary coupling means on said secondary member to couple with the primary coupling means on said further modified member.

18. A method for providing a down-hole conduit for carrying an instrumentation line for use with a well bore, the instrumentation line passing from the surface, towards the bottom of the well bore; said method including the steps of:

providing a hollow primary member having a proximal end and a distal end inserting the hollow primary member to extend into the well bore; providing a first line of conduit on the outer surface of said primary member to extend into the well bore, the first line of conduit having a proximal end adjacent the surface and a lower distal, free end, providing primary coupling means on the primary member for accepting the distal end of said first line of conduit; providing a hollow secondary member having a proximal end and a distal end and comprising a terminal conduit thereon having a proximal, upper free end and a distal end portion and secondary coupling means for accepting the free end of said terminal conduit; and inserting said secondary member distal end leading through said hollow primary member for said primary coupling means to couple with said secondary coupling means for the distal end of said first line of conduit to be coupled to said free end of said terminal conduit.

19. A method, according to claim 18, including the steps of:

providing a second line of conduit on the outside of said primary member to extend into the well bore, the second line of conduit having a proximal end adjacent the surface and a lower distal, free end,; accepting the distal end of said second line of conduit in said primary coupling means; providing said terminal conduit in the form of a loop of conduit so as to form a second, proximal, upper free end and a returned distal end portion ; accepting both free ends of said loop of conduit in said secondary coupling means; coupling said primary coupling means, with said secondary coupling means, for the distal ends of said first and said second lines of conduit each to be coupled to a respective one of said free ends of said loop of conduit; and passing said instrumentation line down said first line of conduit, through said loop of conduit, and back towards the surface in said second line of conduit.

20. A method, according to claim 19, wherein the hollow primary member is tubular and said step of providing said second line of conduit includes the steps of attaching said first line of conduit and said second line of conduit to the outer surface of the hollow primary member and subsequently inserting said primary member into said well bore.

21. A method, according to claim 19 or claim 20 wherein said step of providing said loop of conduit includes the step of attaching said loop of conduit to the outer surface of said secondary member.

22. A method, according to claim 19 or claim 20, wherein the step of causing said primary coupling means to couple with said secondary coupling means includes the steps of employing a locating scoop and a locating tongue to cause said secondary member to achieve correct angular registration with said primary member for said primary and secondary coupling means to couple.

23. A method, according to claim 18, wherein the hollow primary member is tubular and said step of providing said first line of conduit includes the step of attaching said first line of conduit to the outer surface of the hollow primary member and subsequently inserting said primary member into said well bore.

24. A method, according to claim 18, or claim 23 wherein said step of providing said terminal conduit includes the step of attaching said terminal conduit to the outer surface of the secondary member.

25. A method, according to claim 18 or claim 23, wherein the step of causing said primary coupling means to couple with said secondary coupling means includes the steps of employing a locating scoop and a locating tongue to cause said secondary member to achieve correct angular registration with said primary member for said primary and secondary coupling means to couple.

26. A method for providing a down-hole conduit for carrying an instrumentation line for use with a well bore, the instrumentation line passing from the surface, towards the bottom of the well bore; said method including the steps of: providing a hollow primary member having a proximal end and a distal end inserting the hollow primary member to extend into the well bore; providing a first line of conduit and a second line of conduit on the outer surface of said primary member to extend into the well bore, the first and second lines of conduit each having a respective proximal end adjacent the surface and a respective lower distal, free end, providing primary coupling means on the primary member for accepting the distal ends of the first and second lines of conduit;

providing a hollow modified member having a top end and a bottom end and having two extension conduits thereon each having a respective proximal end and a respective distal end and comprising secondary coupling means at the top end of the modified member for accepting the proximal ends of said two extension conduits, and another primary coupling means at a bottom end thereof for accepting the distal ends of said two extension conduits; and inserting said modified member through said primary member and coupling said secondary coupling means on said modified member with said primary coupling means on said primary member to couple the respective distal ends of respective first and second lines of conduit to respective proximal ends of respective extension conduits;

providing a secondary member having a proximal end and a distal end and comprising a terminal conduit looped to provide two proximal, upper, free ends and a distal, returned end portion and, another secondary coupling means on the secondary member for accepting the free ends of said terminal conduit and for coupling with the primary coupling means on the modified member for the distal end of each extension conduit to be coupled to respective ones of the proximal, upper, free ends of said terminal conduit with the distal end of the secondary member and the returned end portion of the terminal conduit extending beyond the bottom end of the modified member and passing said instrumentation line down said first line of conduit and a first extension conduit through said loop of conduit back towards the surface.

27. A method, according to claim 26, including the steps of inserting said secondary member through said modified member and subsequently coupling said secondary coupling means on said secondary member with said primary coupling means on said modified member.

28. A method, according to claim 26, wherein the hollow primary member is tubular and said step of providing said first and said second lines of conduit includes the steps of attaching said first line of conduit and said second line of conduit to the outer surface of the hollow primary member and subsequently inserting the primary member into the well bore.

29. A method for providing a down-hole conduit for carrying an instrumentation line for use with a well bore, the instrumentation line passing from the surface, towards the bottom of the well bore; said method including the steps of:

providing a hollow primary member having a proximal end and a distal end, inserting the hollow primary member to extend into the well bore; providing a line of conduit on the outer surface of said primary member to extend into the well bore, the first line of conduit having a proximal end adjacent the surface and a respective lower distal, free end, providing primary coupling means on the primary member for accepting the distal end of the line of conduit;

providing a hollow modified member having a top end and a bottom end and an extension conduit thereon, the extension conduit having a proximal end and a distal end and comprising secondary coupling means at the top end of the modified member for accepting the proximal ends of said extension conduit, and another primary coupling means at a bottom end of the modified member for accepting the distal end of said extension conduit; and inserting said modified member through said primary member and coupling the secondary coupling means on said modified member with the primary coupling means on said primary member to couple the distal end of the line of conduit to the proximal end of the extension conduit;

providing a secondary member having a proximal end and a distal end and comprising a terminal conduit thereon having a proximal, upper free end and a distal end portion and another secondary coupling means for accepting the free end of said terminal conduit; and inserting said secondary member, distal end leading, through said hollow primary member for the primary coupling means on the modified member to couple with the secondary coupling means on the secondary member for the distal end of said extension conduit to be coupled to said free end of said terminal conduit with the distal end of the secondary member and the distal end portion of said terminal conduit exiting beyond the bottom end of the modified member.

30. A method, according to claim 29, wherein the hollow primary member is tubular and said step of providing said first line of conduit includes the step of attaching said first line of conduit to the outer surface of the hollow primary member and subsequently inserting said primary member into said well bore.

31. A method, according to claim 29 including the steps of inserting said secondary member through said modified member and subsequently coupling the secondary coupling means on said secondary member with the primary coupling means on said modified member.

32. A method for providing a down-hole conduit for carrying an instrumentation line for use with a well bore, the instrumentation line passing from the surface, towards the bottom of the well bore; said method including the steps of:

providing a hollow primary member having a proximal end and a distal end inserting the hollow primary member to extend into the well bore; providing a first line of conduit and a second line of conduit on the outer surface of said primary member to extend into the well bore, the first and second lines of conduit each having a respective proximal end adjacent the surface and a respective lower distal, free end, providing primary coupling means on the primary member for accepting the distal ends of the first and second lines of conduit;

providing a first hollow modified member and a further hollow modified member each having a top end and a bottom end and comprising, respectively, first and further pairs of extension conduits, the extension conduits of each pair having, respectively, top, free ends and bottom, free ends; and first secondary coupling means and a further secondary coupling means at respective top ends of the first and further modified members, respectively, for accepting, respectively, the top, free ends of the first extension conduits and the top, free ends of the further extension conduits, respectively and another primary coupling means and a further primary coupling means at respective bottom ends of the first modified member and the further modified member, respectively, for accepting, bottom, free ends of the first extension conduits and bottom, free ends of the second extension conduits, respectively, and inserting the first modified member bottom end leading, through said hollow primary member for said primary coupling means of said primary member to couple with said secondary coupling means of the first modified member for the distal ends of the first and second lines of conduit to be coupled to respective top, free ends of the extension conduits of the first pair with the bottom end of the first modified member exiting from the distal end of the primary member, and inserting the second modified member bottom end leading, through said primary member and through said first modified member for said primary coupling means of said first modified member to couple with said secondary coupling means of the second modified member for the bottom ends of the extension conduits of the first pair to be coupled to respective top ends of the extension conduits of the second pair and with the bottom end of the second modified member exiting from the bottom end of the first modified member;

and providing a secondary member having a proximal end and a distal end and comprising a terminal conduit looped to provide two proximal, upper, free ends and a distal, returned end portion and, another secondary coupling means on the secondary member for accepting the free ends of said terminal conduit and coupling the secondary coupling means on the secondary member with the primary coupling means on the further modified member for the distal end of each extension conduit to be coupled to respective ones of the proximal, upper, free ends of said terminal conduit with the distal end of the secondary member and the returned end portion of the terminal conduit extending beyond the bottom end of the further modified member and passing said instrumentation line down said first line of conduit and a first and further extension conduit through said loop of conduit back towards the surface.

33. A method, according to claim 32, including the steps of inserting said secondary member through said further modified member and subsequently coupling said secondary coupling means on said secondary member with said primary coupling means on said further modified member.

34. A method, according to claim 32, including the steps of inserting said secondary member through said further modified member and subsequently coupling the secondary coupling means on said secondary member with the primary coupling means on said further modified member.

35. A method, according to claim 32, wherein the hollow primary member is tubular and said step of providing said first and said second lines of conduit includes the steps of attaching said first line of conduit and said second line of conduit to the outer surface of the hollow primary member and subsequently inserting the primary member into the well bore.

36. An apparatus for providing a down-hole conduit for carrying an instrumentation line for use with a well bore, the instrumentation line passing from the surface, towards the bottom of the well bore; said apparatus comprising: a hollow primary member having a proximal end and a distal end, for insertion to extend into the well bore with the distal end remote from the surface; said primary member comprising a first line of conduit on an outer surface thereof, the first line of conduit having a proximal end and a distal end and, the primary member further comprising primary coupling means for accepting the distal end of the first line of conduit;

said apparatus further comprising a first hollow modified member and a further hollow modified member each having a top end and a bottom end and comprising, respectively, a first extension conduit and a further extension conduit, each extension conduit having a respective top, free end and a respective bottom, free end; first secondary coupling means and further secondary coupling means being provided at respective top ends of the first modified member and the further modified member, respectively, for accepting, the top, free end of the first extension conduit and the top, free end of the second extension conduit, respectively; and another primary coupling means and a further primary coupling means being provided, respectively, at bottom ends of the first modified member and the further modified member, respectively, for accepting, the bottom, free end of the first extension conduit and the bottom, free end of the second extension conduit, respectively, the first modified member being insertable, bottom end leading, through said hollow primary member for said primary coupling means of said primary member to couple with the secondary coupling means of the first modified member for the distal end of the first line of conduit to be coupled to the top, free end of the first extension conduit with the bottom end of the first modified member exiting from the distal end of the primary member, and the further modified member being insertable, bottom end leading, through said primary member and through said first modified member for the primary coupling means of said first modified member to couple with the secondary coupling means of the further modified member for the bottom end of the first extension conduit to be coupled to the top end of the further extension conduit and with the bottom end of the further modified member exiting from the distal end of the first modified member;

said apparatus additionally comprising a secondary member having a proximal end and a distal end and being insertable through said primary member, the secondary member comprising a terminal conduit having a proximal, free end and a distal end and, another secondary coupling means on the secondary member for accepting the free end of said terminal conduit for the primary coupling means on said further modified member to couple with the secondary coupling means on said terminal member for said bottom end of said extension line of conduit to be coupled to said free end of said terminal conduit with said distal end of said secondary member and said distal end of said terminal conduit extending from said bottom end of said modified member.

37. An apparatus, according to claim 26, wherein said secondary member is insertable through said further modified member for the secondary coupling means on said secondary member to couple with the primary coupling means on said further modified member.

38. A method for providing a down-hole conduit for carrying an instrumentation line for use with a well bore, the instrumentation line passing from the surface, towards the bottom of the well bore; said method including the steps of:

providing a hollow primary member having a proximal end and a distal end inserting the hollow primary member to extend into the well bore; providing a first line of conduit on the outer surface of said primary member to extend into the well bore, the first line of conduit having a proximal end adjacent the surface and a lower, distal, free end;

providing primary coupling means on the primary member for accepting the distal end of the first line of conduit;

providing a first hollow modified member and a further hollow modified member each having a top end and a bottom end and comprising, respectively, first and further extension conduits, the extension conduits each having a top, free end and a bottom, free end; and first secondary coupling means and a further secondary coupling means at respective top ends of the first and further modified members, respectively, for accepting, respectively, the top, free end of the first extension conduit and the top, free ends of the further extension conduit, respectively, and another primary coupling means and a further primary coupling means at respective bottom ends of the first modified member and the further modified member, respectively, for accepting, the bottom, free end of the first extension conduit and inserting the first modified member bottom end leading, through said hollow primary member for said primary coupling means of said primary member to couple with said secondary coupling means of the first modified member for the distal end of the first line of conduit to be coupled to the top, free end of the extension conduit of the first extension conduit with the bottom end of the first modified member exiting from the distal end of the primary member, and inserting the second modified member, bottom end leading, through said primary member and through said first modified member for said primary coupling means of said first modified member to couple with said secondary coupling means of the second modified member for the bottom end of the extension conduit of the first modified member to be coupled to the top end of the extension conduit of the further modified member and with the bottom end of the second modified member exiting from the bottom end of the first modified member;

and providing a secondary member having a proximal end and a distal end and comprising a terminal conduit having a proximal, upper, free end and a distal, returned end and, another secondary coupling means on the secondary member for accepting the free end of said terminal conduit and coupling the secondary coupling means on the secondary member with the primary coupling means on the further modified member for the distal end of the extension conduit to be coupled to the proximal, upper, free end of said terminal conduit with the distal end of the secondary member and the end of the terminal conduit extending beyond the bottom end of the further modified member and, passing said instrumentation line down said first line of conduit through the first and further extension conduit into said terminal conduit.

39. A method, according to claim 38, including the steps of inserting said secondary member through said further modified member and subsequently coupling the secondary coupling means on said secondary member with the primary coupling means on said further modified member.

40. A method, according to claim 38 wherein the hollow primary member is tubular and said step of providing said first line of conduit includes the step of attaching said first line of conduit to the outer surface of the hollow primary member and subsequently inserting said primary member into said well bore.

* * * * *